US010971851B2

(12) United States Patent
Miyamura et al.

(10) Patent No.: US 10,971,851 B2
(45) Date of Patent: Apr. 6, 2021

(54) MINIATURIZED CONNECTOR WITH A TERMINAL HOLDING MEMBER

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP); Toyota Jidosha Kabushiki Kaisha, Toyota (JP)

(72) Inventors: Tetsuya Miyamura, Yokkaichi (JP); Masaaki Tabata, Yokkaichi (JP); Yasuo Omori, Yokkaichi (JP); Hajime Matsui, Yokkaichi (JP); Hiroshi Kobayashi, Toyota (JP); Motoya Hara, Okazaki (JP); Ryutaro Yamazaki, Nisshin (JP)

(73) Assignees: AutoNetworks Technologies, Ltd.; Sumitomo Wiring Systems, Ltd.; Sumitomo Electric Industries, Ltd.; Toyota Jidosha Kabushiki Kaisha

( * ) Notice: Subject to any disclaimer, the term of this patent is extended or adjusted under 35 U.S.C. 154(b) by 246 days.

(21) Appl. No.: 16/088,184

(22) PCT Filed: Sep. 20, 2017

(86) PCT No.: PCT/JP2017/033974
§ 371 (c)(1),
(2) Date: Sep. 25, 2018

(87) PCT Pub. No.: WO2018/070197
PCT Pub. Date: Apr. 19, 2018

(65) Prior Publication Data

US 2020/0303865 A1 Sep. 24, 2020

(30) Foreign Application Priority Data

Oct. 11, 2016 (JP) ..... JP2016-199676

(51) Int. Cl.
*H01R 13/514* (2006.01)
*H01R 13/627* (2006.01)
(Continued)

(52) U.S. Cl.
CPC ..... *H01R 13/514* (2013.01); *H01R 13/6272* (2013.01); *H01R 13/639* (2013.01); *H01R 13/6463* (2013.01); *H01R 2107/00* (2013.01)

(58) Field of Classification Search
CPC ..... H01R 13/514; H01R 13/639; H01R 13/6463; H01R 13/6272; H01R 2107/00; H01R 9/2416; H01R 13/4362
(Continued)

(56) References Cited

U.S. PATENT DOCUMENTS 7,470,156 B2 * 12/2008 Suemitsu ..... H01R 13/4362 439/752
8,187,041 B2 * 5/2012 Ito ..... H01R 13/4361 439/701
(Continued)

FOREIGN PATENT DOCUMENTS

CN 102544856 7/2012
JP 2004-55470 2/2004
(Continued)

OTHER PUBLICATIONS

International Search Report dated Dec. 12, 2017.
Chinese Office Action dated May 29, 2019.

*Primary Examiner* — Travis S Chambers
(74) *Attorney, Agent, or Firm* — Gerald E. Hespos; Michael J. Porco; Matthew T. Hespos

(57) ABSTRACT

The present invention aims to miniaturize a housing. Disclosed is a connector including a female housing (10) having a terminal accommodating chamber (11) formed therein, a first terminal fitting (24) inserted into the terminal accom-
(Continued)

modating chamber (11), an elastically displaceable lock arm (12) formed in the female housing (10), an accommodating recess (14) formed in the female housing (10) and communicating with a deflection space (13) of the lock arm (12), a terminal holding member (41) mounted in the accommodating recess (14), and a pair of second terminal fittings (58) connected to a twisted pair wire (59) and attached to the terminal holding member (41).

11 Claims, 13 Drawing Sheets

(51) Int. Cl.
*H01R 13/639* (2006.01)
*H01R 13/6463* (2011.01)
*H01R 107/00* (2006.01)

(58) Field of Classification Search
USPC ..... 439/660, 354, 695, 701, 752, 752.5
See application file for complete search history.

(56) References Cited

U.S. PATENT DOCUMENTS

| | | | | |
|---|---|---|---|---|
| 8,636,536 | B2 | 1/2014 | Suemitsu et al. | |
| 8,747,169 | B2 * | 6/2014 | Ito | H01R 13/4361 439/752 |
| 10,320,116 | B2 * | 6/2019 | Miyamura | H01R 13/533 |
| 10,615,532 | B2 * | 4/2020 | Miyamura | H01R 13/42 |
| 10,770,838 | B2 * | 9/2020 | Miyamura | H01R 13/6463 |
| 2005/0095876 | A1 | 5/2005 | Nishide | |
| 2005/0170704 | A1 * | 8/2005 | Ishikawa | H01R 13/516 439/752 |
| 2011/0250793 | A1 * | 10/2011 | Yokozeki | H01R 13/506 439/626 |
| 2012/0164866 | A1 | 6/2012 | Suemitsu et al. | |
| 2015/0155670 | A1 * | 6/2015 | Gardner | H01R 13/5208 439/587 |

FOREIGN PATENT DOCUMENTS

| | | |
|---|---|---|
| JP | 2005-135685 | 5/2005 |
| JP | 2005-216813 | 8/2005 |
| JP | 2015-216015 | 12/2015 |
| JP | 2015-537327 | 12/2015 |

* cited by examiner

MINIATURIZED CONNECTOR WITH A TERMINAL HOLDING MEMBER

BACKGROUND

Field of the Invention

The present invention relates to a connector.

Related Art

Japanese Unexamined Patent Application Publication No. 2004-055470 discloses a connector used for an in-vehicle LAN (local area network). A wire harness for an in-vehicle LAN is formed by bundling a communication wire constituting a twisted pair wire as a noise countermeasure and a power supply wire for supplying power to equipment such as a car navigation system. Terminal fittings secured to end portions of these electric wires are inserted into a terminal accommodating chamber in a housing.

The terminal fittings connected to the two communication wires constituting the twisted pair wire are individually inserted into the terminal accommodating chamber. Thus, the end portion of the communication wire is untwisted in order to secure extra length for individual insertion; however, the noise countermeasure function is lost in the untwisted region.

As a countermeasure against this, it is conceivable to attach the two terminal fittings connected to the two communication wires to a terminal holding member having a half split structure, which is separate from the housing. If the terminal holding member has the half split structure, the terminal fitting can be attached in a direction crossing the longitudinal direction of the communication wire, so that it is unnecessary to untwist the communication wire with the result that deterioration of the noise countermeasure function can be avoided.

However, when the terminal holding member separate from the housing is used, the housing requires a space for accommodating the terminal holding member in addition to the space for accommodating the terminal fitting, so that such a new problem occurs that the housing is increased in size.

The present invention has been completed based on the above situation and aims to miniaturize a housing.

SUMMARY

The present invention is directed to a connector including:

a housing having a terminal accommodating chamber formed therein, a first terminal fitting inserted into the terminal accommodating chamber, an elastically displaceable lock arm formed in the housing, an accommodating recess formed in the housing and communicating with a deflection space of the lock arm, a terminal holding member mounted in the accommodating recess, and a pair of second terminal fittings connected to a twisted pair wire and attached to the terminal holding member.

The accommodating recess in which the terminal holding member is accommodated communicates with the deflection space of the lock arm. Accordingly, the housing can be miniaturized as compared with the case where the accommodating recess and the deflection space are partitioned by a partition wall.

An excessive deflection restricting portion may be formed in an opening portion open toward the deflection space in the accommodating recess to restrict excessive elastic displacement of the lock arm toward the terminal holding member. According to this configuration, interference between the lock arm and the terminal holding member can be prevented by the excessive deflection restricting portion.

An escape recess may be formed in a region of an outer surface of the terminal holding member facing the deflection space. The escape recess avoids interference with the lock arm in a state in which the lock arm abuts against the excessive deflection restricting portion. According to this configuration, while an elastic displacement amount of the lock arm is secured, an accommodating position of the terminal holding member can be brought close to the lock arm.

The paired second terminal fittings may be arranged side by side in a direction crossing an arrangement direction of the deflection space and the accommodating recess. According to this configuration, it is possible to further miniaturize the housing in the arrangement direction of the deflection space and the accommodating recess.

DETAILED DESCRIPTION

Embodiment 1

Figure 1:
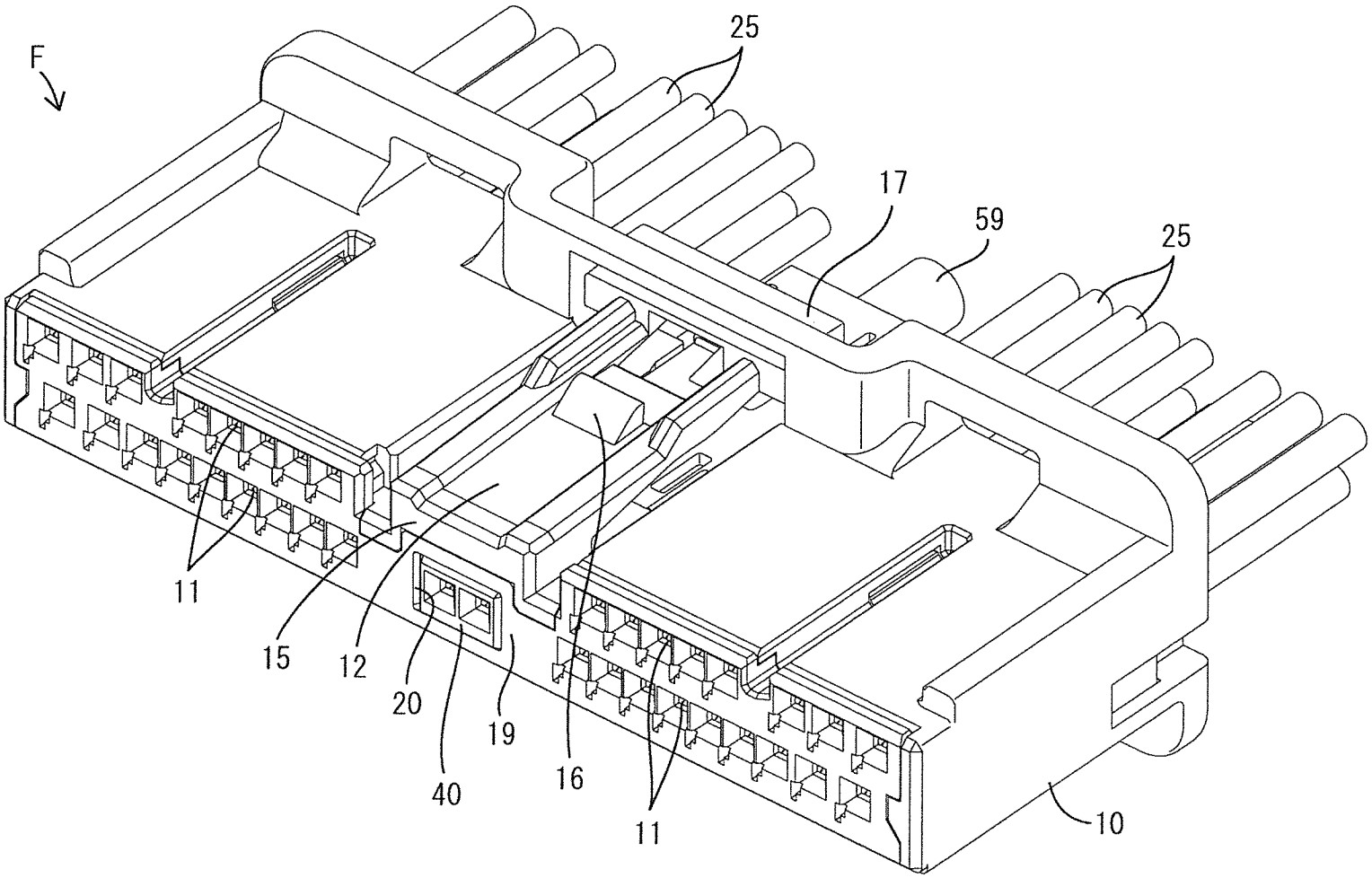
FIG. 1 is a perspective view of a female connector of Embodiment 1.
Figure 2:
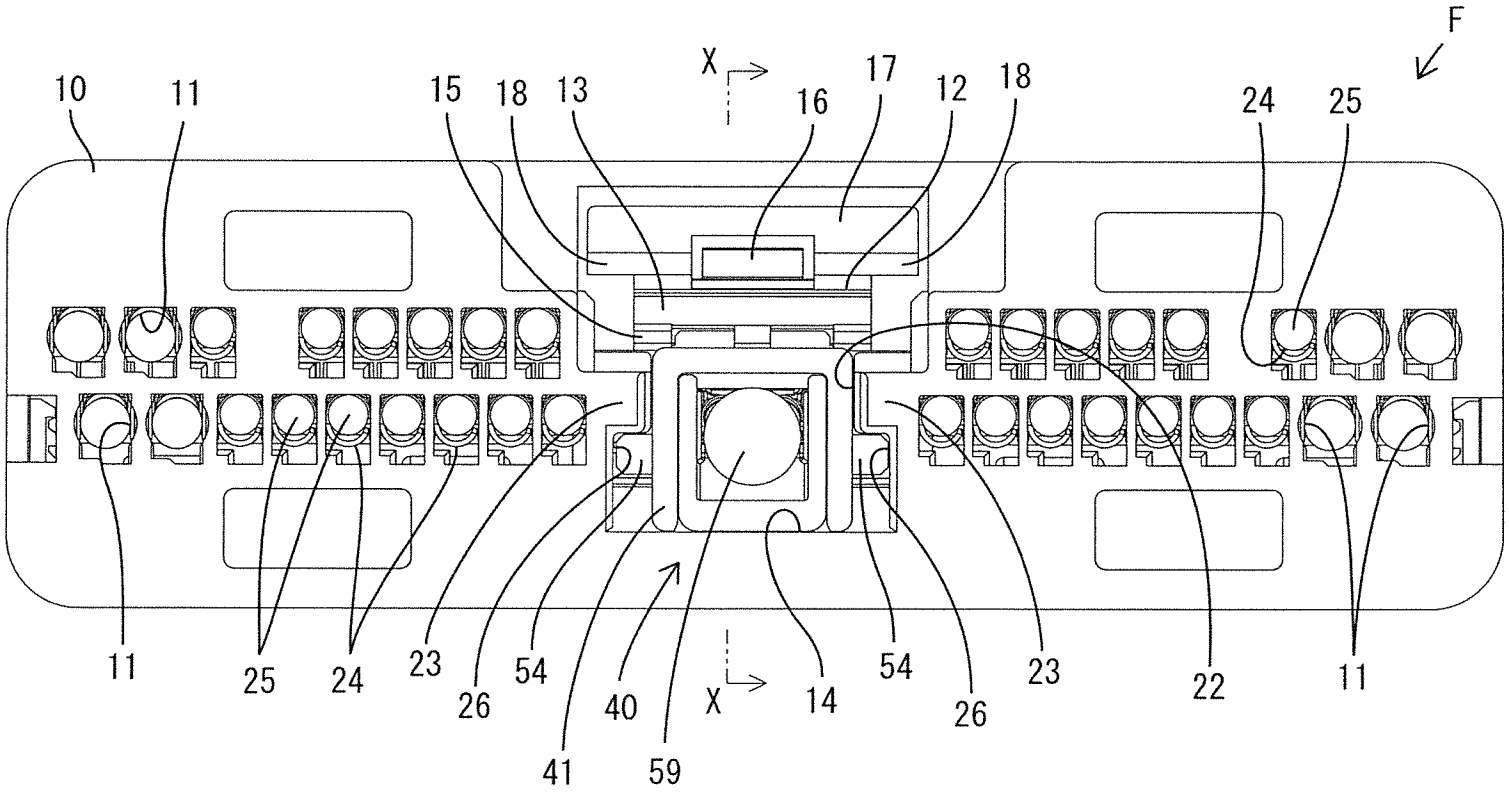
FIG. 2 is a rear view of the female connector.
Figure 3:
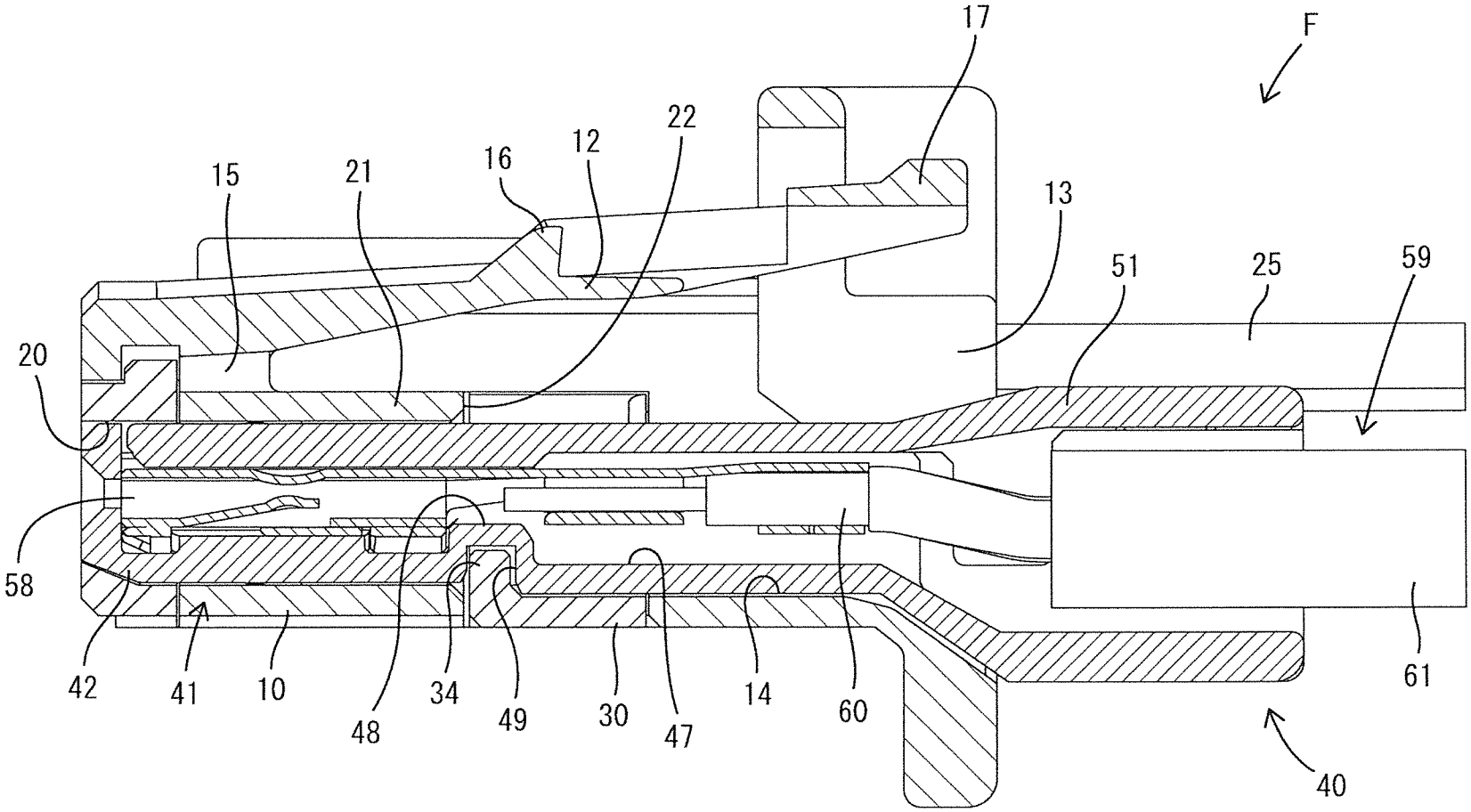
FIG. 3 is a cross-sectional view taken along line X-X in FIG. 2.
Figure 4:
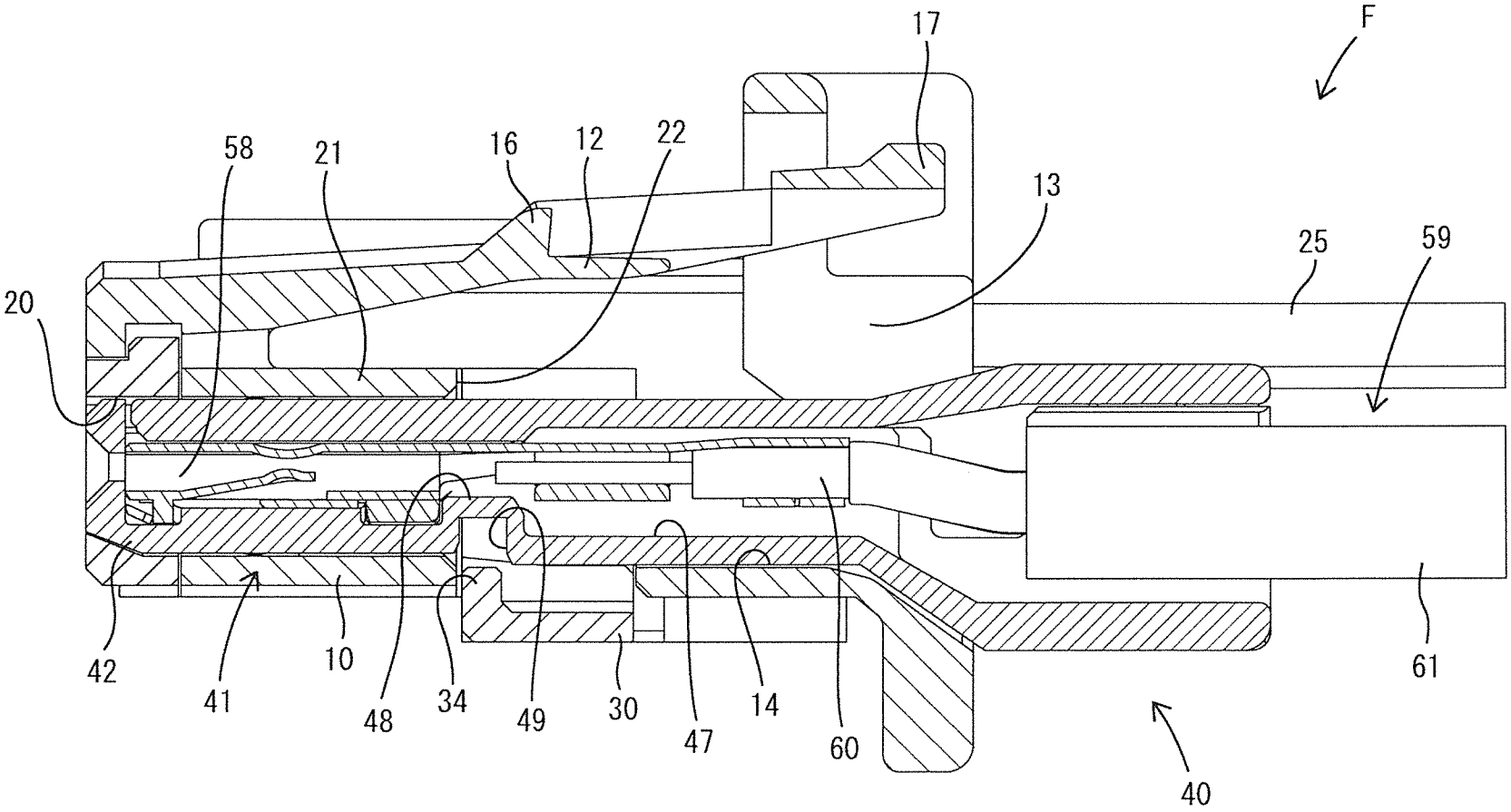
FIG. 4 is a cross-sectional view showing a state in which a retainer is located at a temporary locking position and corresponding to the line X-X in FIG. 2.

Hereinafter, Embodiment 1 in which the present invention is embodied will be described with reference to FIGS. 1 to 13. In the following description, as for a front-rear direction, the left side in FIGS. 3 to 5 and 8 is defined as the front side. As for an up-down direction, the directions shown in FIGS. 2 to 6 and 8 are defined as upward and downward as they are.

A female connector F (connector described in the claims) of the present embodiment includes a female housing 10 (housing described in the claims) made of synthetic resin, a plurality of first female terminal fittings 24, a retainer 30 made of synthetic resin, and a terminal unit 40.

The female housing 10 as a whole has a flat shape having a right-left dimension (width dimension) larger than an up-down dimension. Inside the female housing 10, a plurality of terminal accommodating chambers 11 is formed. In each of the terminal accommodating chambers 11, the first terminal fitting 24 is inserted from behind the female housing 10. The inserted first terminal fitting 24 is prevented from being disconnected by engagement with a lance formed in the terminal accommodating chamber 11. Each of the first terminal fittings 24 is connected to a first electric wire 25 which has no countermeasure against noise.

A lock arm 12 disposed so as to face an upper surface of the female housing 10 is formed at a central portion in a width direction of the female housing 10. The lock arm 12 has a plate shape with its thickness direction directed in the up-down direction. A front end portion of the lock arm 12 is a deflection fulcrum portion 15 continued to the upper surface of the female housing 10. The lock arm 12 extends rearward from the deflection fulcrum portion 15 in a cantilevered manner and can be elastically displaced downward in a lock release direction (direction approaching the upper surface of the female housing 10) with the deflection fulcrum portion 15 serving as a fulcrum. In a free state in which the lock arm 12 is not elastically displaced, a space between a lower surface of the lock arm 12 and the upper surface of the female housing 10 is a deflection space 13 for allowing elastic displacement of the lock arm 12.

A locking protrusion 16 is formed at a substantially central portion of the lock arm 12 in the front-rear direction. A rear end portion of the lock arm 12 is a release operating portion 17 for elastically displacing the lock arm 12 in the lock release direction. A central portion in a width direction (right-left direction) of a lower surface of the release operating portion 17 is recessed by mold drawing with a mold (not shown), and regions on the right and left sides sandwiching the central recessed portion of the lower surface of the release operating portion 17 are protruding portions 18 which relatively protrudes downward.

An accommodating recess 14 disposed below the lock arm 12 is formed at the central portion in the width direction of the female housing 10. The accommodating recess 14 extends to be elongated in the front-rear direction, and a rear end portion of the accommodating recess 14 is opened as an insertion opening for inserting the terminal unit 40 on a rear end surface of the female housing 10. A front wall portion 19 constituting a front end surface of the female housing 10 is formed at a front end portion of the accommodating recess 14. A fitting opening 20 communicating from the front end surface of the female housing 10 to the inside of the accommodating recess 14 is opened at a central portion in a width direction of the front wall portion 19.

A region on the front end side of the upper surface of the accommodating recess 14 is covered with a partition wall 21 constituting the upper surface of the female housing 10. A formation range in the front-rear direction of the partition wall 21 is a region close to the deflection fulcrum portion 15 of the lock arm 12, that is, a region where, when the lock arm 12 is elastically displaced in the lock release direction, there is no possibility of interference with the lock arm 12.

A region on the rear end side of an upper surface of the accommodating recess 14 is opened upward over the entire width and is an opening 22 communicating with the deflection space 13. A formation region in the front-rear direction of the opening 22 is a range extending from a rear end of the partition wall 21 to the rear end of the accommodating recess 14 (the female housing 10). The region where the opening 22 is formed includes a region to which, when the lock arm 12 is elastically displaced in the lock release direction, the release operating portion 17 with the maximum displacement amount is closest.

The width dimension of the accommodating recess 14 is smaller than the width dimensions of the lock arm 12 and the deflection space 13. An opening edge portion of the opening 22 of the upper surface of the female housing 10 (a surface facing the lower surface of the lock arm 12) functions as a pair of right and left excessive deflection restricting portions 23. When the lock arm 12 is elastically displaced in the lock release direction, if the protruding portion 18 on the lower surface of the release operating portion 17 abuts against the excessive deflection restricting portion 23, further displacement of the lock arm 12 in the lock release direction is restricted. The right and left inner surfaces of the accommodating recess 14 are formed with a pair of right and left symmetrical guide grooves 26. The guide grooves 26 each extend in the front-rear direction (a direction parallel to an assembling direction of the terminal unit 40 with respect to the female housing 10).

Figure 11:
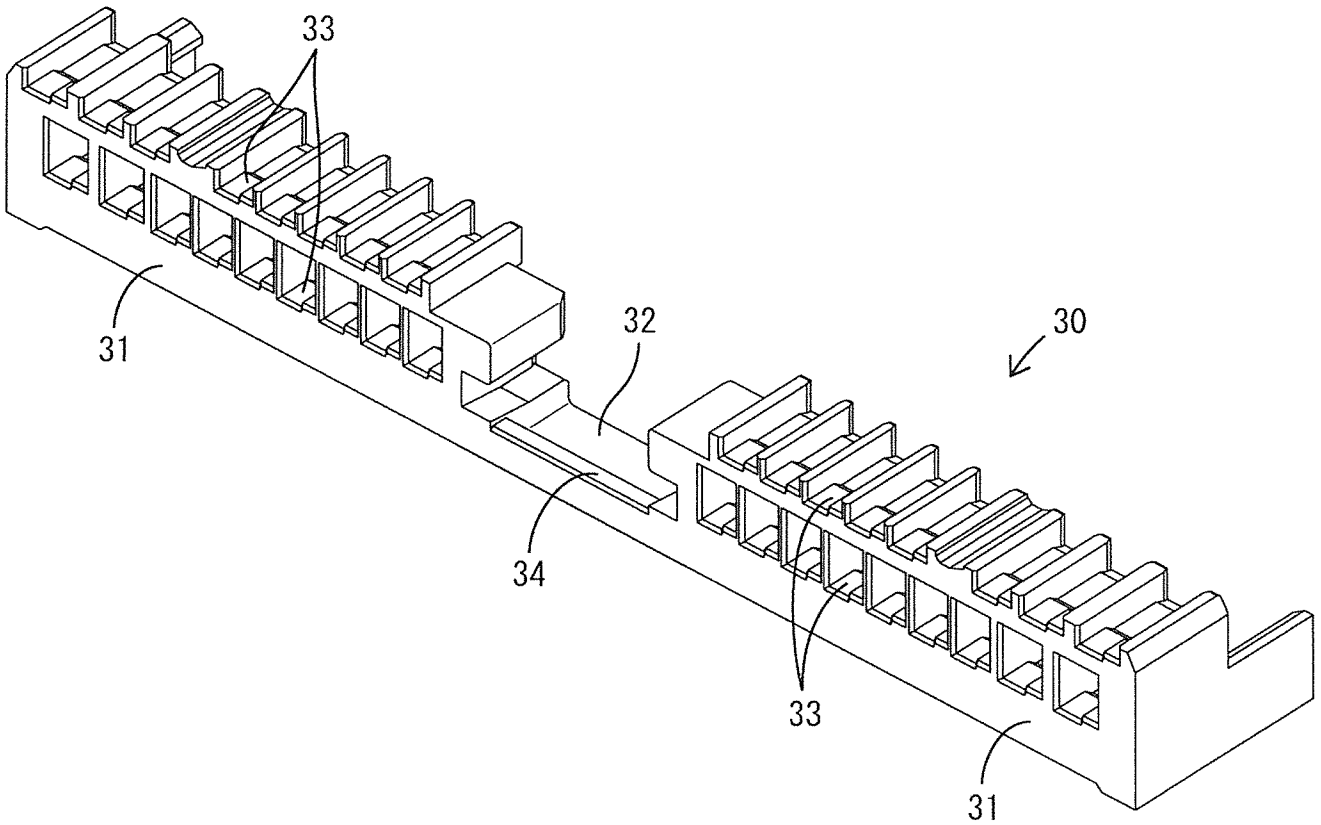
FIG. 11 is a perspective view of the retainer.

As shown in FIG. 11, the retainer 30 is elongated in the right-left direction as a whole. The retainer 30 is a single component including a pair of right and left retaining function portions 31 and a horizontal plate-shaped connecting portion 32 connecting lower end edge portions of the right and left retaining function portions 31 with each other. The retaining function portion 31 includes a plurality of retaining protrusions 33 which are locked to the plurality of first terminal fittings 24 inserted into the plurality of terminal accommodating chambers 11 and thereby capable of retaining the plurality of first terminal fittings 24. In the plate-shaped connecting portion 32, the thickness direction thereof is directed in the up-down direction. A retaining rib 34 extending in the right-left direction is formed on an upper surface of the plate-shaped connecting portion 32.

The retainer 30 is assembled to the female housing 10 from below. The assembled retainer 30 is selectively assembled to the female housing 10 at a regular locking position (see FIGS. 3 and 5) or at a temporary locking position (see FIG. 4) slightly lower than the regular locking position. The retainer 30 is attached to a substantially central position of the female housing 10 in the front-rear direction.

In the state in which the retainer 30 is located at the regular locking position, the entire retaining function portion 31 is accommodated inside the female housing 10, and the retaining protrusion 33 is disposed at a position to retain the first terminal fitting 24. Similarly, in the state in which the retainer 30 is at the regular locking position, a portion of the plate-shaped connecting portion 32 other than the retaining rib 34 is accommodated below the accommodating recess 14 in the female housing 10, and the retaining rib 34 enters the accommodating recess 14.

In the state in which the retainer 30 is located at the temporary locking position, substantially the entire retaining function portion 31 excluding the lower end portion is accommodated in the housing, and the retaining protrusion 33 is retracted at a position not to retain the first terminal fitting 24 (that is, a position allowing insertion and removal of the first terminal fitting 24 into and from the terminal accommodating chamber 11). Similarly, in the state in which the retainer 30 is at the temporary locking position, the entire plate-shaped connecting portion 32 including the retaining rib 34 is accommodated in the female housing 10 below the accommodating recess 14. A lower surface of the female housing 10 has a height difference in the front-rear direction, and a region rearward of the retainer 30 is lower than a region ahead of the retainer 30. In the state in which the retainer 30 is at the regular locking position, a region of the lower surface of the female housing 10 rearward of the retainer 30 and the lower surface of the retainer 30 are arranged flush with each other at the same level.

Figure 7:
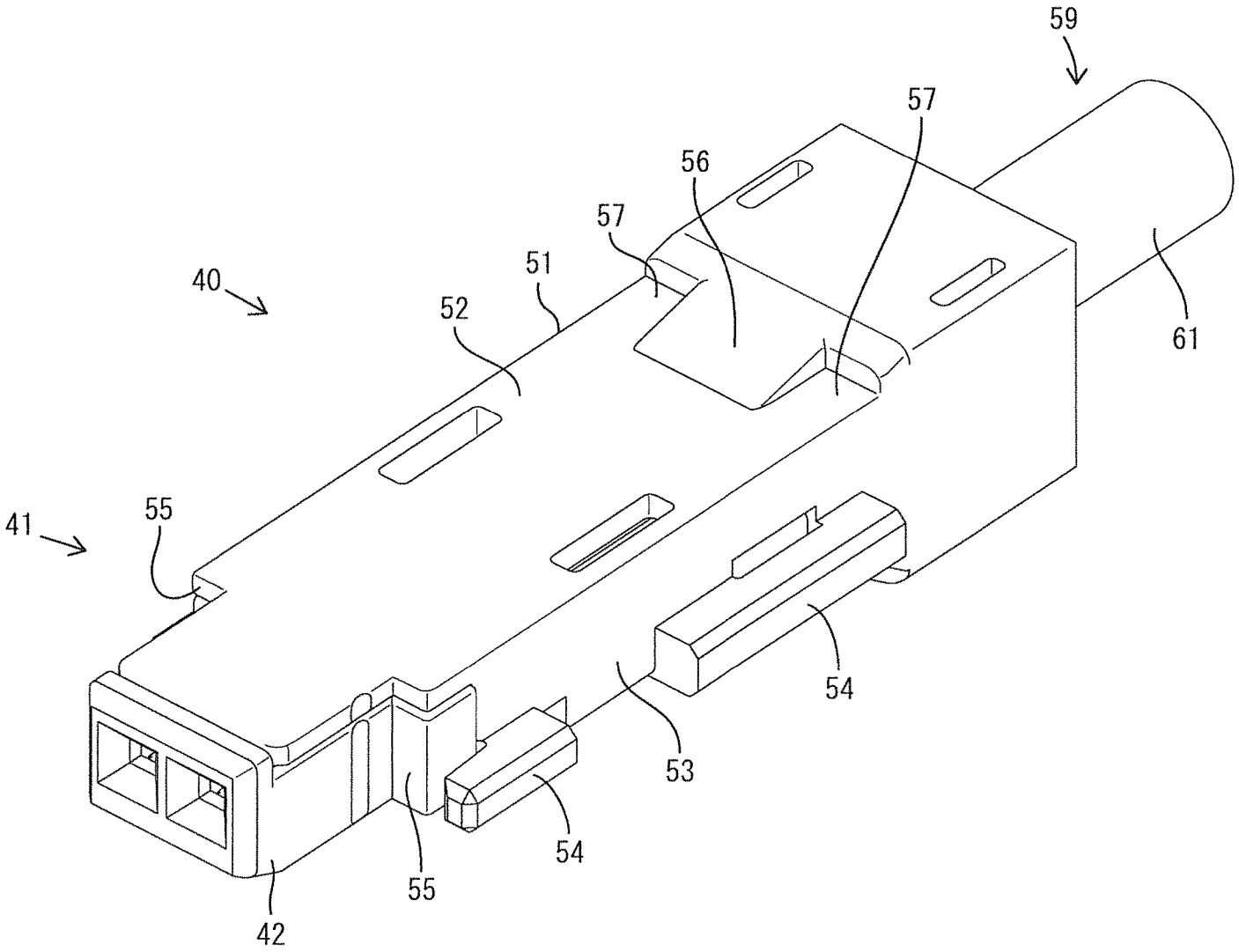
FIG. 7 is a perspective view of a terminal unit.
Figure 8:
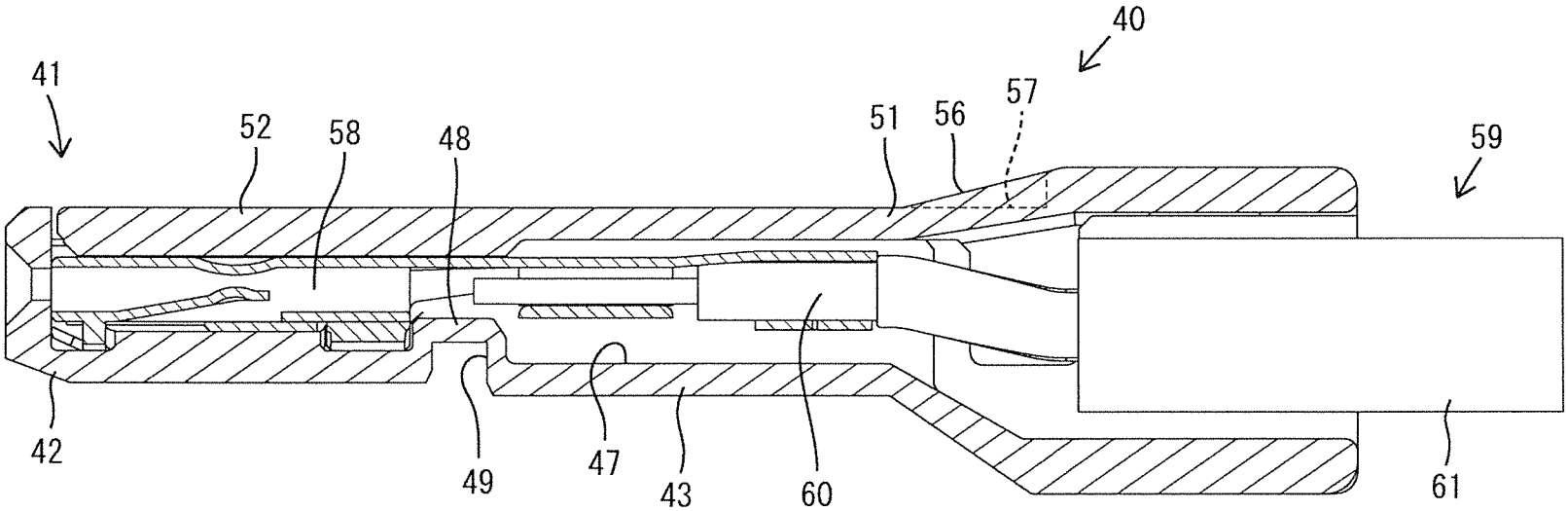
FIG. 8 is a cross-sectional view of the terminal unit.

The terminal unit 40 includes a terminal holding member 41 made of synthetic resin and a pair of second female terminal fittings 58, and is connected to a front end portion of a twisted pair wire 59. As shown in FIGS. 7 and 8, the terminal unit 40 is elongated in the front-rear direction as a whole, and is accommodated in the accommodating recess 14 from behind the female housing 10. The terminal holding member 41 is constructed by assembling a lower case 42 (see FIG. 9) and an upper case 51 (see FIG. 9) so that they are united vertically. The assembling direction of the two cases 42 and 51 is a direction crossing the length direction of the twisted pair wire 59.

Figure 9:
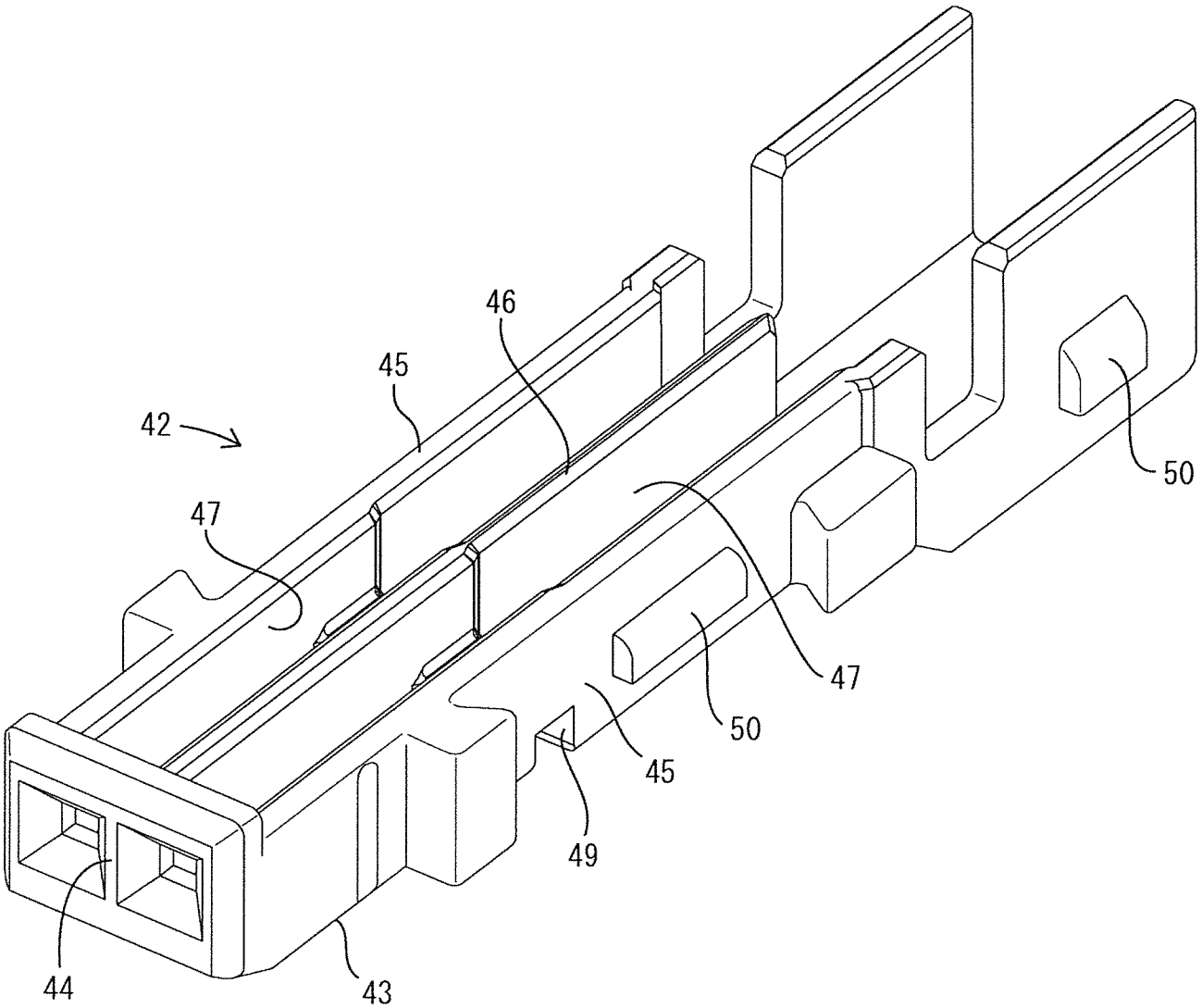
FIG. 9 is a perspective view of a lower case constituting a terminal holding member.

As shown in FIG. 9, the lower case 42 includes a bottom wall 43 extending in the front-rear direction, a front wall 44 rising upward from a front end edge of the bottom wall 43, a pair of outer side walls 45 rising upward from right and left side edges of the bottom wall 43, and an intermediate wall 46 rising upward from the center in a width direction of the bottom wall 43. The lower case 42 has a pair of right and left symmetrical terminal accommodating grooves 47 partitioned by the bottom wall 43, the pair of right and left outer side walls 45, and the intermediate wall 46. The bottom wall 43 is formed with a locking protrusion 48 entering the terminal accommodating groove 47. A locking groove 49 in the right-left direction is formed in a region of the bottom wall 43 where the locking protrusion 48 is formed. The outer surfaces of the right and left outer side walls 45 are formed with two pairs of assembly protrusions 50 which are spaced apart in the front-rear direction.

The second terminal fitting 58 is accommodated in each of the terminal accommodating grooves 47. The second terminal fitting 58 and the first terminal fitting 24 are common parts having the same shape and dimension. The second terminal fitting 58 is held in a state where rearward separation is restricted by the locking protrusion 48 protruding from the bottom wall 43. The second terminal fittings 58 are respectively connected to front end portions of two second electric wires 60.

The two second electric wires 60 are used as communication wires (signal wires), and are twisted helically thereby to constitute the twisted pair wire 59 having a noise reduction function. In a region of the twisted pair wire 59 excluding the front end portion, the two second electric wires 60 are collectively surrounded by a sheath 61. A front end portion of the sheath 61 is also accommodated in a rear end portion of the terminal accommodating groove 47.

The second terminal fitting 58 is mounted in the terminal accommodating groove 47 from above the lower case 42. The mounting direction of the second terminal fitting 58 is a direction crossing the length direction of the twisted pair wire 59. Accordingly, the sheath 61 may be removed to expose the second electric wire 60 at the front end portion of the twisted pair wire 59 only by a dimension required for crimping the second terminal fitting 58 and the second electric wire 60 by a crimping machine (applicator).

Figure 10:
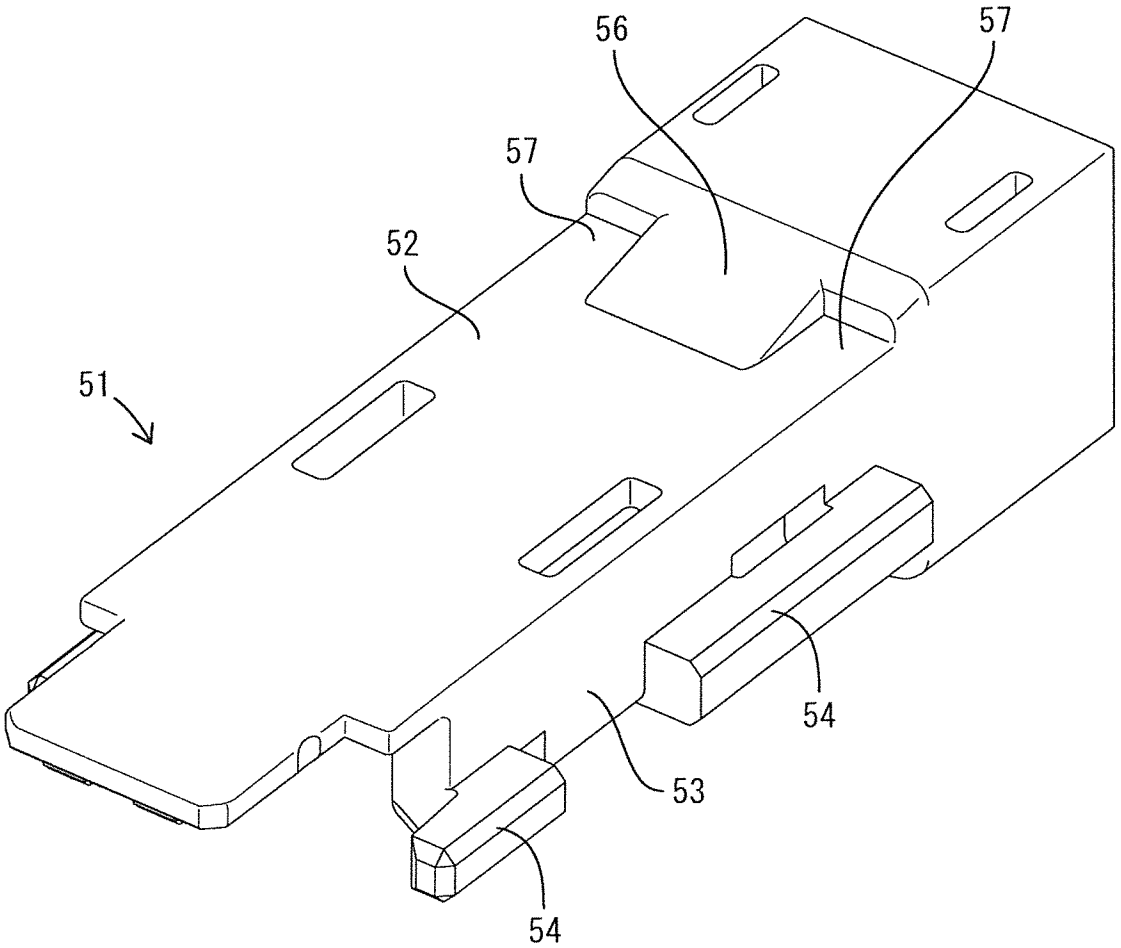
FIG. 10 is a perspective view of an upper case constituting the terminal holding member.

As shown in FIG. 10, the upper case 51 includes an upper wall portion 52 and a pair of side wall portions 53 extending downward from right and left side edges of the upper wall portion 52. The outer surfaces of the right and left side wall portions 53 are formed with two pairs of guide ribs 54 arranged at intervals in the front-rear direction and extending in the front-rear direction. The inner surfaces of both the side wall portions 53 are formed with assembly receiving portions (not shown).

In a state in which the lower case 42 and the upper case 51 are united and assembled, both the cases 42 and 51 are locked in an assembled state by locking the assembly protrusion 50 of the lower case 42 and the assembly receiving portion of the upper case 51. Since an opening in an upper surface of the terminal accommodating groove 47 is closed by the upper wall portion 52 in the assembled state of both the cases, the second terminal fitting 58 is prevented from being separated outside the terminal accommodating groove 47. The right and left outer surfaces of the terminal holding member 41 is formed with a pair of right and left abutting portions 55 facing forward.

There is a dimensional difference between the height of the second terminal fitting 58 and the diameter of the sheath 61. Thus, in the upper wall portion 52, the height of a region corresponding to the sheath 61 is higher than the height of a region corresponding to the second terminal fitting 58 in the front-rear direction. Between the two regions having a height difference, a central portion in a width direction of the upper wall portion 52 is an inclined portion 56 which is inclined so as to gradually become higher toward the rear side. Regions on right and left sides of the inclined portion 56 of the upper wall portion 52 are escape recesses 57 relatively lower than the inclined portion 56. The escape recesses 57 are each continued with the region corresponding to the second terminal fitting 58 in a flush manner at the same level.

Figure 5:
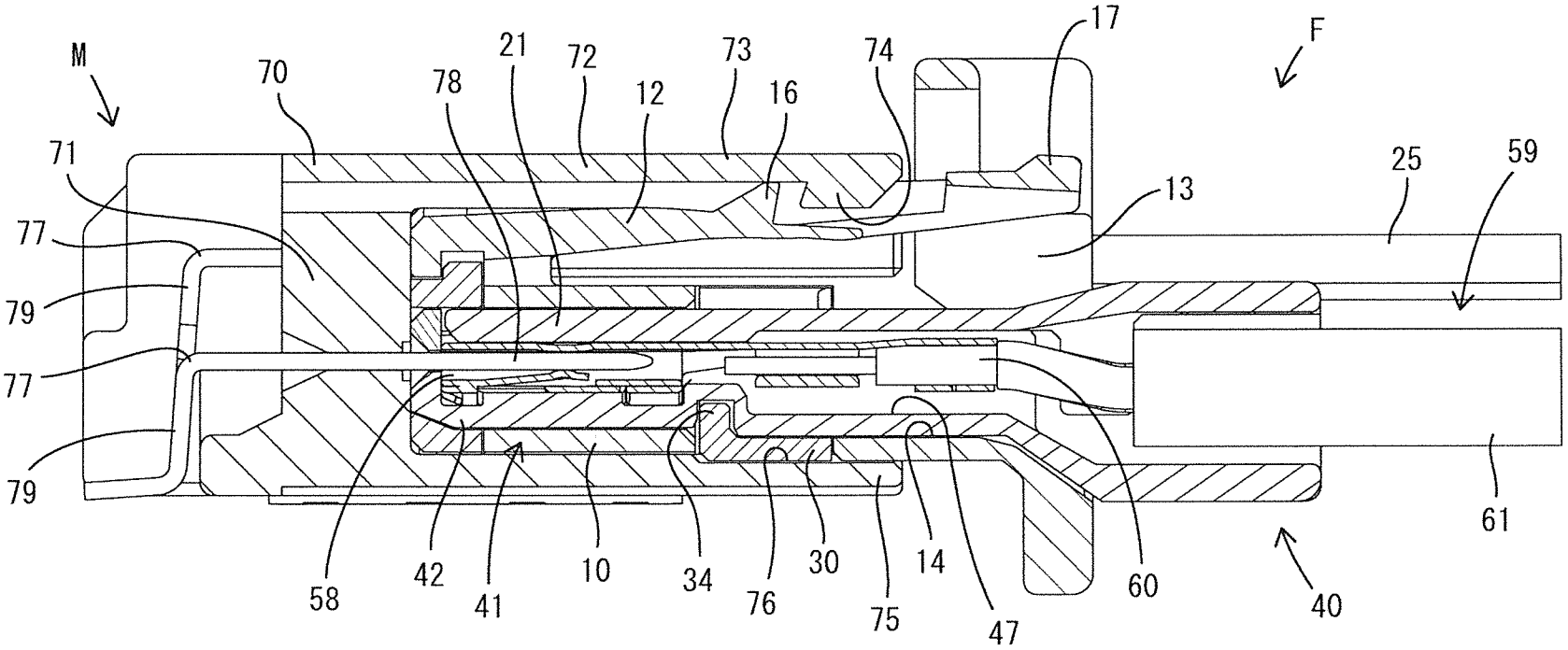
FIG. 5 is a cross-sectional view showing a state in which the female connector and a male connector are fitted.
Figure 6:
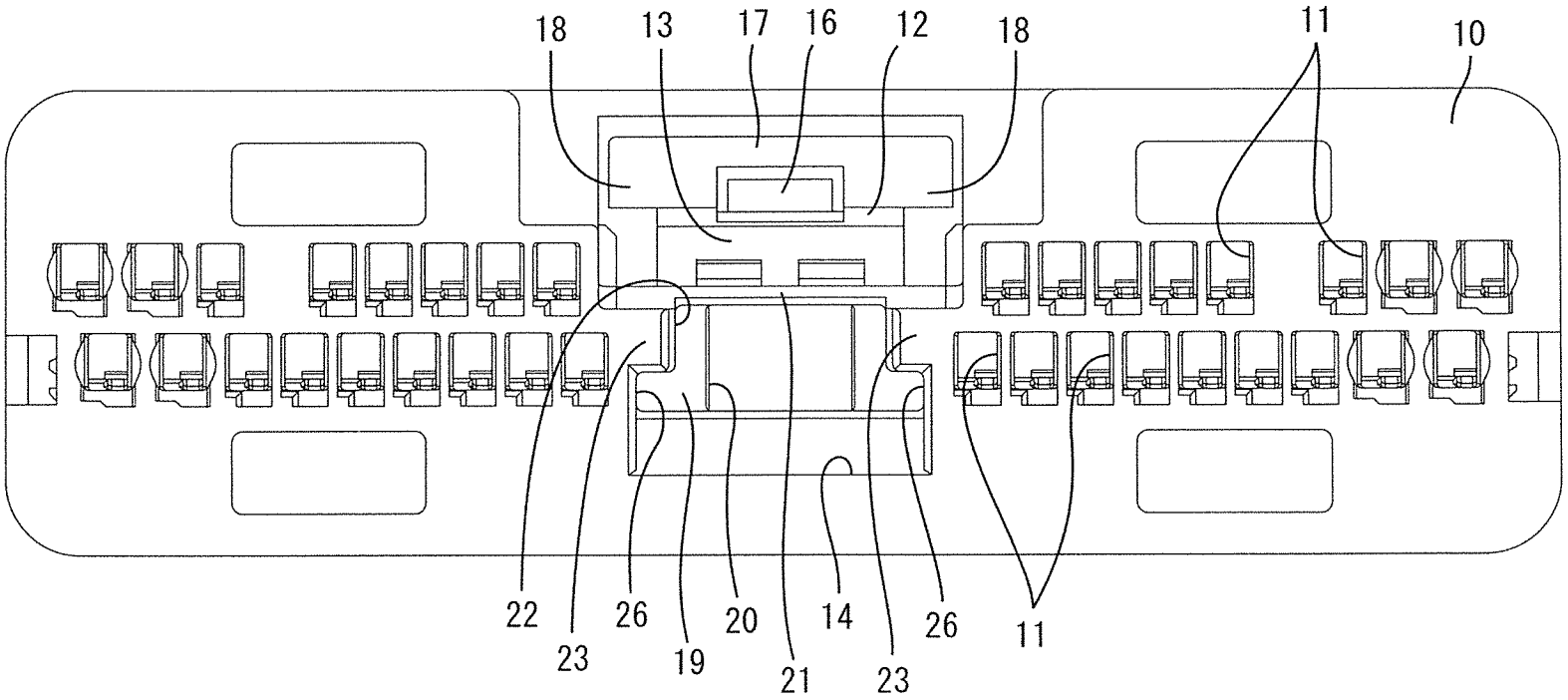
FIG. 6 is a rear view of a female housing.
Figure 12:
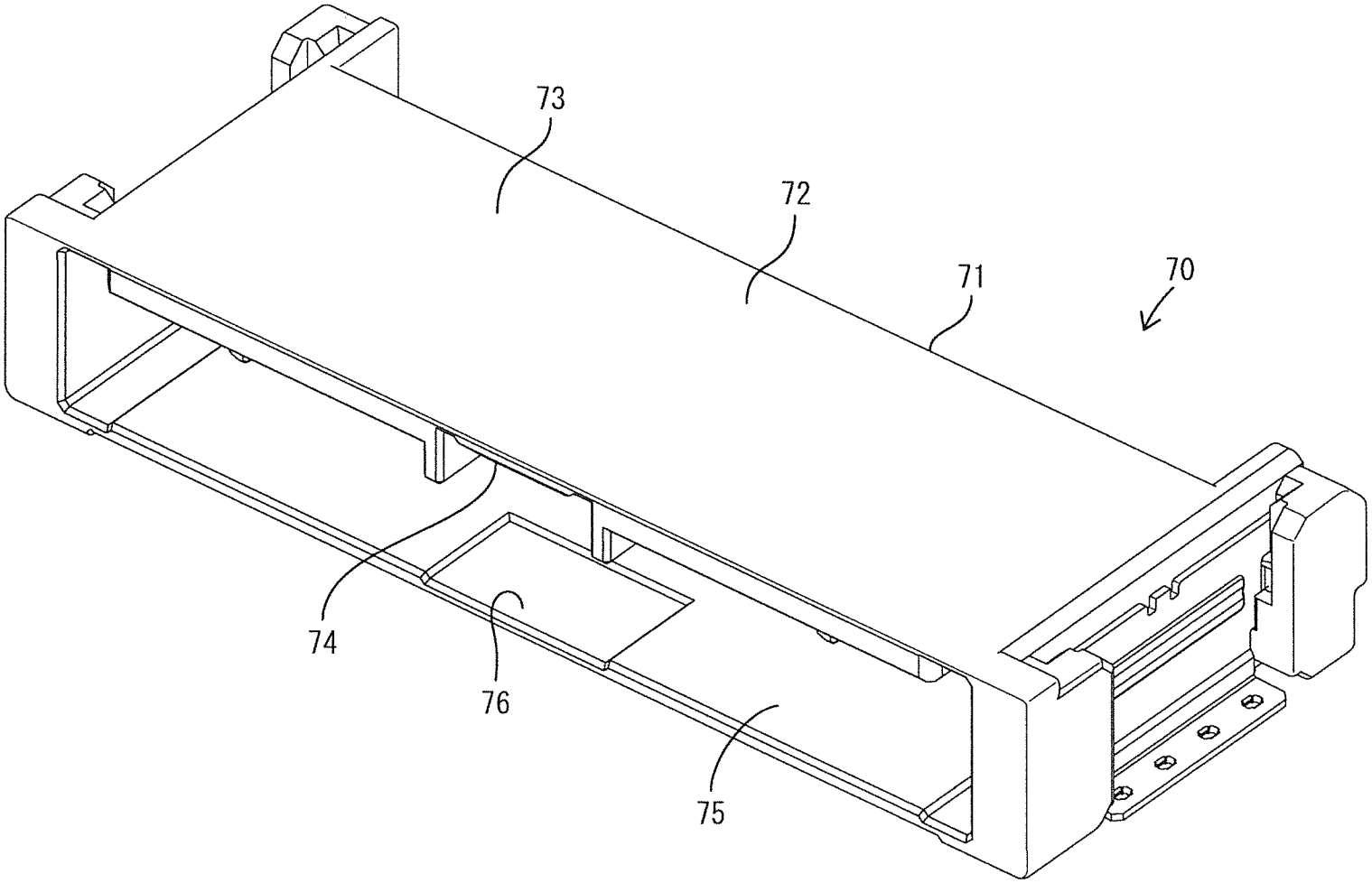
FIG. 12 is a perspective view of the male connector.
Figure 13:
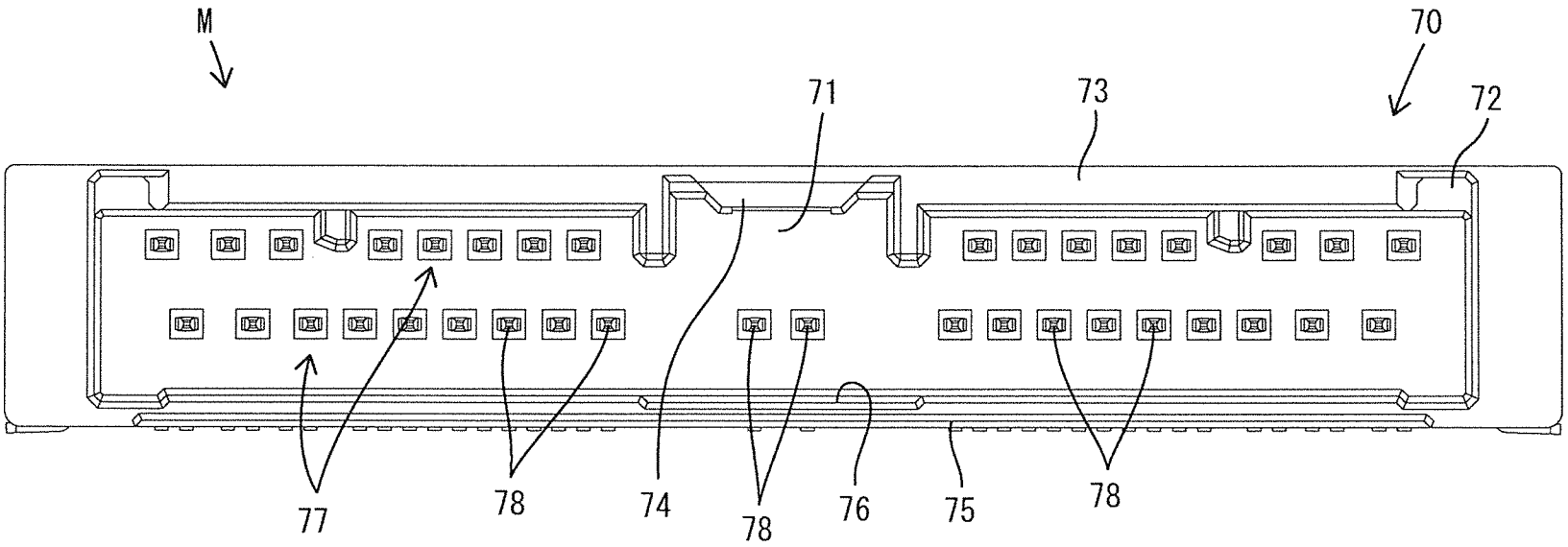
FIG. 13 is a front view of the male connector.

A male connector M includes a male housing 70 and a plurality of male terminal fittings 77. As shown in FIGS. 5, 12, and 13, the male housing 70 is a single component including a wall-shaped terminal support portion 71 and a rectangular tubular hood portion 72 extending from an outer peripheral edge of the terminal support portion 71 toward the front side (female connector F side). The male terminal fitting 77 is attached to the terminal support portion 71 in a state of being penetrated by press fitting.

The male terminal fitting 77 includes a tab 78 horizontally protruding from the terminal support portion 71 into the hood portion 72 and a board connecting portion 79 which is exposed to the rear side from the terminal support portion 71 and extends downward. An inner surface (lower surface) of an upper plate portion 73 constituting the hood portion 72 is formed with a stepped lock portion 74. A concave portion 76 is formed in a region close to an opening edge of a lower plate portion 75 constituting the hood portion 72.

Next, an assembling procedure of the female connector F will be described. First, the retainer 30 is assembled to the female housing 10 in which the first terminal fitting 24 and the terminal unit 40 are not attached, and the retainer 30 is held at the temporary locking position by a locking means (not shown). Then, the first terminal fitting 24 is inserted into each of the terminal accommodating chambers 11 from the rear side of the female housing 10, and the first terminal fitting 24 is primarily locked by a lance (not shown) formed in the terminal accommodating chamber 11.

Before or after the process of inserting the first terminal fitting 24 into the terminal accommodating chamber 11, the terminal unit 40 is inserted into the accommodating recess 14 from the rear side of the female housing 10. At the time of insertion, the guide rib 54 and the guide groove 26 are fitted and brought into sliding contact with each other. As a result, the terminal unit 40 slides while maintaining an appropriate posture with respect to the female housing 10. When the terminal unit 40 reaches a proper insertion position, the abutting portion 55 of the terminal unit 40 abuts against the front wall portion 19, and the locking groove 49 is located just above the retaining rib 34.

When insertion of all the first terminal fittings 24 and insertion of the terminal unit 40 are completed, the retainer 30 at the temporary locking position is pushed up to the regular locking position. At this time, if there is any first terminal fitting 24 in a semi-inserted state, the retaining protrusion 33 interferes with the first terminal fitting 24 in the semi-inserted state, so that the retainer 30 cannot be displaced to the regular locking position. Also, if the terminal unit 40 has not reached the proper insertion position, the retaining rib 34 interferes with the bottom wall 43 of the terminal unit 40, so that the retainer 30 cannot be pushed up to the regular locking position.

When all the first terminal fittings 24 and the terminal unit 40 are properly inserted, it is possible to move the retainer 30 to the regular locking position. Accordingly, the insertion state of the first terminal fitting 24 and the terminal unit 40 can be detected based on whether or not the retainer 30 can be moved to the regular locking position. Furthermore, when the operation of pushing up the retainer 30 to the regular locking position is not performed, the terminal unit 40 separates from the female housing 10, so that it is possible to detect whether or not the retainer 30 has moved to the regular locking position. Thus, the assembly of the female connector F is completed.

When the female connector F is fitted to the male connector M, the female connector F (female housing 10) is fitted into the hood portion 72. Here, the lower surface of the female housing 10 in the region rearward of the retainer 30 is relatively lower than the region ahead of the retainer 30. The lower surface of the retainer 30 at the regular locking position is also disposed so as to be flush with the region of the lower surface of the female housing 10 rearward of the retainer 30 at the same level and aligned in the front-rear direction. However, the lower plate portion 75 constituting the hood portion 72 is formed with a concave portion 76 in order to avoid interference with the region of the lower surface of the female housing 10 rearward of the retainer 30 and with a lower end portion of the retainer 30. Accordingly, the female connector F can be fitted into the hood portion 72 without any problems.

In the process of fitting the female connector F into the hood portion 72, the locking protrusion 16 interferes with a front end edge of the hood portion 72, so that the lock arm 12 is elastically displaced toward the deflection space 13 (in a direction approaching the terminal unit 40). An elastic displacement amount of the lock arm 12 in this fitting process is to such an extent that the release operating portion 17 does not abut against the excessive deflection restricting portion 23. When both the connectors F and M reach a proper fitted state, the lock arm 12 elastically returns, and the lock protrusion 16 is locked to the lock portion 74. By this locking action, both the connectors F and M are locked in a fitted state.

When both the connectors F and M are fitted, the tabs 78 of the male terminal fitting 77 are connected to the first terminal fittings 24 and the second terminal fittings 58. Since the paired right and left second terminal fittings 58 are arranged at the same height as the first terminal fittings 24, the tabs 78 of the male connector M are also arranged so as to be aligned right and left at a fixed height. Since the first terminal fitting 24 and the second terminal fitting 58 are common parts, the male terminal fitting 77 connected to the first terminal fitting 24 and the male terminal fitting 77 connected to the second terminal fitting 58 can be common parts.

When both the connectors F and M are to be separated, the release operating portion 17 is operated to be depressed. With this operation, the lock arm 12 is elastically displaced in the lock release direction and the locking protrusion 16 is separated from the lock portion 74, and thereafter both the connectors F and M may be separated while the release operating portion 17 is being operated for lock release.

At this time, in order to firmly grasp the female connector F, the release operating portion 17 may be depressed until the release operating portion 17 abuts against the excessive deflection restricting portion 23. Even if the release operating portion 17 abuts against the excessive deflection restricting portion 23, the lock arm 12 does not interfere with (abut against) the terminal unit 40. Although the paired right and left protruding portions 18 in the lock arm 12 protrude downward toward the upper surface of the terminal unit 40, the lock arm 12 does not abut against the terminal unit 40 since the paired right and left escape recesses 57 corresponding to the protruding portions 18 are formed in the terminal unit 40.

The female connector F of the present embodiment includes the female housing 10 having the terminal accommodating chamber 11 formed therein and the first terminal fitting 24 inserted into the terminal accommodating chamber 11. The elastically displaceable lock arm 12 and the accommodating recess 14 communicating with the deflection space 13 of the lock arm 12 are formed in the female housing 10. Here, the deflection space 13 is a space corresponding to the rear end side (free end side) of the lock arm 12 in the front-rear direction between the upper surface of the female housing 10 and the lower surface of the lock arm 12.

The terminal unit 40 (terminal holding member 41) is mounted in the accommodating recess 14, and the pair of second terminal fittings 58 connected to the twisted pair wire 59 is attached to the terminal holding member 41. Since the accommodating recess 14 in which the terminal holding member 41 is accommodated communicates with the deflection space 13 of the lock arm 12, the housing can be miniaturized (reduced in height) as compared with the case where the accommodating recess 14 and the deflection space 13 are partitioned by a partition wall.

Furthermore, the excessive deflection restricting portion 23 which restricts excessive elastic displacement of the lock arm 12 toward the terminal holding member 41 is formed at the opening edge portion of the opening 22 open toward the deflection space 13 in the accommodating recess 14. According to this configuration, interference between the lock arm 12 and the terminal holding member 41 can be prevented by the excessive deflection restricting portion 23.

Furthermore, the escape recess 57 which avoids interference with the lock arm 12 in a state in which the lock arm 12 abuts against the excessive deflection restricting portion 23 is formed in a region of the outer surface of the terminal holding member 41 (terminal unit 40), which region faces the deflection space 13. According to this configuration, while the elastic displacement amount of the lock arm 12 is secured, an accommodating position of the terminal holding member 41 can be brought close to the lock arm 12.

Furthermore, the paired second terminal fittings 58 are arranged side by side in a direction (right-left direction) crossing an arrangement direction of the deflection space 13 and the accommodating recess 14 (up-down direction). According to this configuration, it is possible to further miniaturize (reduce the height of) the housing in the arrangement direction of the deflection space 13 and the accommodating recess 14.

Other Embodiments

The present invention is not limited to the above embodiment, which has been described using the foregoing description and the drawings, and, for example, embodiments as described below are also encompassed within the technical scope of the present invention.

(1) In the above embodiment, the excessive deflection restricting portion is formed at the opening portion open toward the deflection space in the accommodating recess. However, the excessive deflection restricting portion may not be formed.

(2) In the above embodiment, the escape recess is formed on the outer surface of the terminal holding member. However, the escape recess may not be formed.

(3) In the above embodiment, the deflection space and the accommodating recess are arranged so as to be aligned in the direction parallel to the elastic displacement direction of the lock arm. However, the deflection space and the accommodating recess may be arranged so as to be aligned in a direction crossing the elastic displacement direction of the lock arm.

(4) In the above embodiment, the paired second terminal fittings are arranged side by side in the direction crossing the arrangement direction of the deflection space and the accommodating recess. However, the paired second terminal fittings may be arranged side by side parallel to the arrangement direction of the deflection space and the accommodating recess.

REFERENCE SIGNS LIST

F female connector (connector)
10 female housing (housing)
11 terminal accommodating chamber
12 lock arm
13 deflection space
14 accommodating recess
23 excessive deflection restricting portion
24 first terminal fitting
41 terminal holding member
57 escape recess
58 second terminal fitting
59 twisted pair wire

The invention claimed is:

1. A miniaturized connector comprising:
- a female housing having a terminal accommodating chamber formed therein, the female housing being configured to be fitted to a male housing;
- a first terminal fitting inserted into the terminal accommodating chamber;
- a lock arm formed in the female housing, the lock arm being elastically displaceable and being configured to hold the female housing and the male housing in a fitted state;
- an accommodating recess formed in the female housing and communicating with a deflection space of the lock arm;
- a terminal holding member mounted in the accommodating recess; and
- a pair of second terminal fittings connected to a twisted pair wire and attached to the terminal holding member.

2. The miniaturized connector according to claim 1, wherein the paired second terminal fittings are arranged side by side in a direction crossing an arrangement direction of the deflection space and the accommodating recess.

3. The miniaturized connector according to claim 1, further comprising an excessive deflection restricting portion which is formed at an opening portion open toward the deflection space in the accommodating recess and restricts excessive elastic displacement of the lock arm toward the terminal holding member.

4. The miniaturized connector according to claim 3, wherein the paired second terminal fittings are arranged side by side in a direction crossing an arrangement direction of the deflection space and the accommodating recess.

5. The miniaturized connector according to claim 3, further comprising an escape recess which is formed in a region of an outer surface of the terminal holding member, which region faces the deflection space, and avoids interference with the lock arm in a state in which the lock arm abuts against the excessive deflection restricting portion.

6. The miniaturized connector according to claim 5, wherein the paired second terminal fittings are arranged side by side in a direction crossing an arrangement direction of the deflection space and the accommodating recess.

7. A miniaturized connector assembly comprising:
- a male housing;
- at least one first male terminal and two second male terminals mounted in the male housing;
- a female housing configured to be fit together with the male housing, the female housing being formed with a lock arm, the lock arm being elastically displaceable into a deflection space in the female housing and being configured to hold the female housing and the male housing in a fitted state, the female housing having at least one terminal accommodating chamber formed therein, an accommodating recess formed in the female housing and communicating with a deflection space of the lock arm;
- at least one first female terminal fitting inserted respectively into the at least one terminal accommodating chamber of the female housing and being connected respectively to the at least one first male terminal when the female housing and the male housing are in the fitted state;
- a terminal holding member mounted in the accommodating recess; and
- a pair of second female terminal fittings connected to a twisted pair wire and attached to the terminal holding member.

8. The miniaturized connector assembly according to claim 7, wherein the paired second terminal fittings are arranged side by side in a direction crossing an arrangement direction of the deflection space and the accommodating recess.

9. The miniaturized connector assembly according to claim 7, wherein the at least one first male terminal fitting comprises plural first male terminal fittings, and the at least one first female terminal fitting comprises plural first female terminal fittings, the first male terminal fittings being connected respectively to the plural first female terminal fittings.

10. A connector comprising:
- a housing formed with a terminal accommodating chamber and a deflection space formed therein, an elastically displaceable lock arm formed in the housing and being deflectable into the deflection space, an accommodating recess formed in the housing and communicating with the deflection space and an excessive deflection restricting portion formed in the accommodating recess at an opening portion that is open toward the deflection space;
- a first terminal fitting inserted into the terminal accommodating chamber;
- a terminal holding member mounted in the accommodating recess; and
- a pair of second terminal fittings connected to a twisted pair wire and attached to the terminal holding member, wherein the excessive deflection restricting portion restricts excessive elastic displacement of the lock arm toward the terminal holding member.

11. The connector according to claim 10, further comprising an escape recess formed in a region of an outer surface of the terminal holding member that faces the deflection space, and avoids interference with the lock arm in a state in which the lock arm abuts against the excessive deflection restricting portion.

* * * * *